US009148735B2

(12) United States Patent
Ma et al.

(10) Patent No.: US 9,148,735 B2
(45) **Date of Patent: *Sep. 29, 2015**

(54) HEARING AID WITH IMPROVED LOCALIZATION

(71) Applicant: GN ReSound A/S, Ballerup (DK)

(72) Inventors: Guilin Ma, Lybgby (DK); Karl-Fredrik Johan Gran, Malmö (SE)

(73) Assignee: GN RESOUND A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/872,590

(22) Filed: Apr. 29, 2013

(65) Prior Publication Data

US 2014/0185849 A1 Jul. 3, 2014

(30) Foreign Application Priority Data

Dec. 28, 2012 (EP) ..... 12199744

(51) Int. Cl.
*H04R 25/00* (2006.01)

(52) U.S. Cl.
CPC ..... *H04R 25/453* (2013.01); *H04R 25/407* (2013.01); *H04R 25/552* (2013.01); *H04R 2225/021* (2013.01)

(58) Field of Classification Search
None
See application file for complete search history.

(56) References Cited

U.S. PATENT DOCUMENTS

| | | | |
|---|---|---|---|
| 5,325,463 | A | 6/1994 | Murata et al. |
| 5,473,702 | A | 12/1995 | Yoshida et al. |
| 8,208,642 | B2 | 6/2012 | Edwards |
| 2001/0002930 | A1 | 6/2001 | Kates |
| 2004/0136541 | A1 | 7/2004 | Hamacher et al. |
| 2007/0086602 | A1 | 4/2007 | Petersen et al. |
| 2007/0183603 | A1 | 8/2007 | Jin et al. |
| 2009/0067651 | A1 | 3/2009 | Klinkby et al. |
| 2009/0097681 | A1 | 4/2009 | Puria et al. |
| 2009/0202091 | A1 | 8/2009 | Pedersen et al. |
| 2009/0262964 | A1 | 10/2009 | Havenith et al. |
| 2010/0092016 | A1 | 4/2010 | Iwano et al. |
| 2010/0303267 | A1 | 12/2010 | Pedersen et al. |

(Continued)

FOREIGN PATENT DOCUMENTS

| | | |
|---|---|---|
| EP | 1 414 268 | 4/2004 |
| EP | 1 594 344 | 11/2005 |

(Continued)

OTHER PUBLICATIONS

Extended European Search Report dated Jun. 21, 2012 for EP Patent App. No. 11196089.4.

(Continued)

*Primary Examiner* — Duc Nguyen
*Assistant Examiner* — Taunya McCarty
(74) *Attorney, Agent, or Firm* — Vista IP Law Group, LLP

(57) ABSTRACT

A hearing aid includes: a feedback monitor connected to the adaptive feedback canceller and configured to monitor a state of feedback and having an output providing an indication of the state of feedback; and a cue controller connected to the feedback monitor and the at least one adaptive cue filter, and configured to control, in response to an output of the feedback monitor, the at least one adaptive cue filter so that the difference between the output of the at least one ITE microphone and the combined output of the at least one adaptive cue filter is reduced.

15 Claims, 10 Drawing Sheets

(56) References Cited

U.S. PATENT DOCUMENTS

| | | | |
|---|---|---|---|
| 2012/0308019 | A1 | 12/2012 | Edwards |
| 2012/0308057 | A1 | 12/2012 | Edwards et al. |
| 2013/0064403 | A1 | 3/2013 | Hasler et al. |

FOREIGN PATENT DOCUMENTS

| | | | |
|---|---|---|---|
| EP | 2 088 802 | | 8/2009 |
| EP | 2 124 483 | | 11/2009 |
| EP | 2 391 145 | | 11/2011 |
| EP | 2 584 794 | A1 | 4/2013 |
| EP | 2 611 218 | | 7/2013 |
| WO | WO 0225996 | A1 | 3/2002 |
| WO | 2006/037156 | | 4/2006 |
| WO | 2006/042540 | A1 | 4/2006 |
| WO | 2008/010716 | A2 | 1/2008 |
| WO | WO 2009/049320 | | 4/2009 |
| WO | 2011/098153 | A1 | 8/2011 |

OTHER PUBLICATIONS

First Office Action dated Jun. 20, 2012 for DK Patent App. No. PA 2011 70759.
Second Technical Examination, Intention to Grant dated Jan. 18, 2013 for DK Patent App. No. PA 2011 70759.
Notice of Allowance & Fees Due dated Apr. 16, 2013 for U.S. Appl. No. 13/352,133.
Extended European Search Report dated May 2, 2013 for EP Patent App. No. 12197705.2.
Extended European Search Report dated Jun. 5, 2013 for EP Patent App. No. 12199761.3.
Extended European Search Report dated May 27, 2013 for EP Patent App. No. 12199744.9.
First Technical Examination and Search Report dated May 31, 2013 for DK Patent Application No. PA 2012 70833.
First Technical Examination and Search Report dated Jun. 4, 2013 for DK Patent Application No. PA 2012 70832.
First Technical Examination and Search Report dated Aug. 12, 2013 for DK Patent Application No. PA 2012 70836.
Extended European Search Report dated May 31, 2013 for EP Patent Application No. 12199720.9.
Notice of Allowance and Fees Due dated Sep. 16, 2013 for U.S. Appl. No. 13/352,133, 6 pages.
Second Technical Examination—Intention to Grant dated Apr. 22, 2014 for related DK Patent Application No. PA 2012 70832, 2 pages.
Second Technical Examination and Intention to Grant dated Feb. 27, 2014 for DK Patent Application No. PA 2012 70836.
First Technical Examination Search Report dated Nov. 18, 2103 for related Danish Patent Application No. PA 2013 70273, 4 pages.
Extended European Search Report dated Aug. 9, 2013 for EP Patent Application No. 13168718.8.
Non-final Office Action dated Jul. 28, 2014 for U.S. Appl. No. 13/901,386.
Non-Final Office Action dated Sep. 15, 2014 for U.S. Appl. No. 13/872,459.
First Technical Examination and Search Report dated Aug. 28, 2014, for related DK Patent Application No. PA 2014 70178, 6 pages.
Non-final Office Action dated Jan. 5, 2015 for U.S. Appl. No. 13/872,720.
Notification of Reason for Rejection dated Nov. 11, 2014 for related Japanese Patent Application No. 2013-266879, 4 pages.
Notification of Reason for Rejection dated Nov. 5, 2013 for related Japanese Patent Application No. 2012-281443, 4 pages.
Extended European Search Report dated Jan. 20, 2015 for related European Patent Application No. 14163573.0, 8 pages.
Notice of Allowance and Fees Due dated Feb. 4, 2015 for U.S. Appl. No. 13/872,459.
Final Office Action dated Dec. 10, 2014 for U.S. Appl. No. 13/901,386.
Notice of Allowance and Fees Due dated Mar. 31, 2015 for U.S. Appl. No. 13/901,386.
Notice of Allowance and Fees Due dated Apr. 15, 2015 for U.S. Appl. No. 13/872,459.
Second Technical Examination dated Mar. 20, 2015 for related Danish Patent Application No. PA 2014 70178, 3 pages.
Third Technical Examination dated Apr. 17, 2015 for related Danish Patent Application No. PA 2014 70178, 2 pages.
Fourth Technical Examination—Intention to Grant dated May 18, 2015 for related Danish Patent Application No. PA 2014 70178, 2 pages.
Final Office Action dated Jul. 17, 2015 for related U.S. Appl. No. 13/872,720.
Non-final Office Action dated Aug. 10, 2015 for related U.S. Appl. No. 14/252,631.

HEARING AID WITH IMPROVED LOCALIZATION

RELATED APPLICATION DATA

This application claims priority to, and the benefit of, Danish Patent Application No. PA 2012 70833, filed on Dec. 28, 2012, and European Patent Application No. 12199744.9, filed on Dec. 28, 2012. The disclosures of all of the above applications are expressly incorporated by reference in their entireties herein.

FIELD

A new hearing aid is provided with improved localization of sound sources with relation to the wearer of the hearing aid.

BACKGROUND

Hearing aid users have been reported to have poorer ability to localize sound sources when wearing their hearing aids than without their hearing aids. This represents a serious problem for the mild-to-moderate hearing impaired population.

Furthermore, hearing aids typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Thus, there is a need for a new hearing aid with improved localization of sound sources, i.e. the new hearing aid preserves information of the directions and distances of respective sound sources in the sound environment with relation to the orientation of the head of the wearer of the hearing aid.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The transmission of a sound wave from a sound source positioned at a given direction and distance in relation to the left and right ears of the listener is described in terms of two transfer functions, one for the left ear and one for the right ear, that include any linear distortion, such as coloration, interaural time differences and interaural spectral differences. Such a set of two transfer functions, one for the left ear and one for the right ear, is called a Head-Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The hearing aid related transfer function is defined similar to a HRTF, namely as the ratio between a sound pressure p generated by the hearing aid at a specific point in the appertaining ear canal in response to a plane wave and a reference. The reference traditionally chosen is the sound pressure $p_I$ that would have been generated by a plane wave at a position right in the middle of the head with the listener absent.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a playback unit, such as a tape recorder, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal-to-noise ratio (SNR); direction of arrival (DOA) estimation; depth/distance perception and synergy between the visual and auditory systems.

The complex shape of the ear is a major contributor to the individual spatial-spectral cues (ITD, ILD and spectral cues) of a listener. Devices which pick up sound behind the ear will, hence, be at a disadvantage in reproducing the HRTF since much of the spectral detail will be lost or heavily distorted.

This is exemplified in FIGS. 1 and 2 where the angular frequency spectrum of an open ear, i.e. non-occluded, measurement is shown in FIG. 1 for comparison with FIG. 2 showing the corresponding measurement on the front microphone on a behind the ear device (BTE) using the same ear. The open ear spectrum shown in FIG. 1 is rich in detail whereas the BTE result shown in FIG. 2 is much more blurred and much of the spectral detail is lost.

SUMMARY

It is therefore desirable to position one or more microphones of the hearing aid at position(s) with relation to a user wearing the hearing aid in which spatial cues of sounds arriving at the user is preserved. It is for example advantageous to position a microphone in the outer ear of the user in front of the pinna, for example at the entrance to the ear canal; or, inside the ear canal, in order to preserve spatial cues of sounds arriving at the ear to a much larger extent than what is possible with the microphone behind the ear. A position below the triangular fossa has also proven advantageous with relation to preservation of spatial cues.

Positioning of a microphone at the entrance to the ear canal or inside the ear canal leads to the problem that the microphone is moved close to the sound emitting device of the hearing aid, whereby the risk of feedback generation is increased, which in turn limits the maximum stable gain which can be prescribed with the hearing aid.

The standard way of solving this problem is to completely seal off the ear canal using a custom mould. This, however, introduces the occlusion effect as well as comfort issues with respect to moisture and heat.

For comparison, the maximum stable gain of a BTE hearing aid with front and rear microphones positioned behind the ear, and an In-The-Ear (ITE) hearing aid with an open fitted microphone positioned in the ear canal is shown in FIG. 2. It can be seen that the ITE hearing aid has much lower maximum stable gain (MSG) than the front and rear BTE microphones for nearly all frequencies.

In the new hearing aid, output signals of an arbitrary configuration of microphones undergo signal processing in such a way that spatial cues are preserved and conveyed to the user of the hearing aid. The output signals are filtered with filters that are configured to preserve spatial cues.

The new hearing aid provides improved localization to the user by providing, in addition to conventionally positioned microphones as in a BTE hearing aid, at least one ITE microphone intended to be positioned in the outer ear of the user in front of the pinna, e.g. at the entrance to the ear canal or immediately below the triangular fossa; or, inside the ear canal, when in use in order to record sound arriving at the ear of the user and containing the desired spatial information relating to localization of sound sources in the sound environment.

The processor of the new hearing aid combines an audio signal of the at least one ITE microphone residing in the outer ear of the user with the microphone signal(s) of the conventionally positioned microphone(s) as in a BTE hearing aid in such a way that spatial cues are preserved. An audio signal of the at least one ITE microphone may be formed as a weighted sum of the output signals of each microphone of the at least one ITE microphone. Other forms of signal processing may be included in the formation of the audio signal of the at least one ITE microphone.

Thus, a hearing aid is provided, comprising a BTE hearing aid housing configured to be worn behind the pinna of a user, at least one BTE sound input transducer, such as an omnidirectional microphone, a directional microphone, a transducer for an implantable hearing aid, a telecoil, a receiver of a digital audio datastream, etc., accommodated in the BTE hearing aid housing, each of which is configured for conversion of a sound signal into a respective audio signal, an ITE microphone housing configured to be positioned in the outer ear of the user for fastening and retaining, in its intended position, at least one ITE microphone accommodated in the ITE microphone housing, each of which is configured for conversion of acoustic sound into a respective audio signal, at least one adaptive cue filter, each of which having

- an input that is provided with an output signal from a respective one of the at least one BTE sound input transducer, and
- the filter coefficients of which are adapted so that the difference between an output signal of the at least one ITE microphone and a combined output signal of the at least one adaptive cue filter is reduced, and preferably eventually minimized or substantially minimized, a processor configured to generate a hearing loss compensated output signal based on a combination of the filtered audio signals output by the at least one cue filter, an output transducer for conversion of the hearing loss compensated output signal to an auditory output signal that can be received by the human auditory system, an adaptive feedback canceller for feedback suppression and having

- an input connected to an output of the processor for reception of the hearing loss compensated output signal,
- at least one output modelling the feedback path from the output of the output transducer to the respective at least one BTE microphone and connected to a subtractor for subtraction of the at least one output of the adaptive feedback canceller from the output of the respective at least one BTE microphone and
- outputting the difference to the respective at least one adaptive cue filter, The hearing aid further comprises a feedback monitor connected to the adaptive feedback canceller and configured to monitor the state of feedback and having an output providing an indication of the state of feedback, a cue controller connected to the output of the feedback monitor and the output of the at least one adaptive cue filter, and configured to control, in response to the output signal of the feedback monitor, the at least one adaptive cue filter so that the difference between an output signal of the at least one ITE microphone and a combined output signal of the at least one adaptive cue filter is reduced, and preferably eventually minimized or substantially minimized.

The hearing aid may further comprise a sound signal transmission member for transmission of a sound signal from a sound output in the BTE hearing aid housing at a first end of the sound signal transmission member to the ear canal of the user at a second end of the sound signal transmission member, an earpiece configured to be inserted in the ear canal of the user for fastening and retaining the sound signal transmission member in its intended position in the ear canal of the user.

Throughout the present disclosure, the "output signals of the at least one ITE microphone" may be used to identify any analogue or digital signal forming part of the signal path from the output of the at least one ITE microphone to an input of the processor, including pre-processed output signals of the at least one ITE microphone.

Likewise, the "output signals of the at least one BTE sound input transducer" may be used to identify any analogue or digital signal forming part of the signal path from the at least one BTE sound input transducer to an input of the processor, including pre-processed output signals of the at least one BTE sound input transducer.

In use, the at least one ITE microphone is positioned so that the output signal of the at least one ITE microphone generated in response to the incoming sound has a transfer function that constitutes a good approximation to the HRTFs of the user. For example, the at least one ITE microphone may be constituted by a single microphone positioned at the entrance to the ear canal. The processor conveys the directional information contained in the output signal of the at least one ITE microphone to the resulting hearing loss compensated output signal of the processor so that the hearing loss compensated output signal of the processor also attains a transfer function that constitutes a good approximation to the HRTFs of the user whereby improved localization is provided to the user.

BTE (behind-the-ear) hearings aids are well-known in the art. A BTE hearing aid has a BTE housing that is shaped to be worn behind the pinna of the user. The BTE housing accommodates components for hearing loss compensation. A sound signal transmission member, i.e. a sound tube or an electrical conductor, transmits a signal representing the hearing loss compensated sound from the BTE housing into the ear canal of the user.

In order to position the sound signal transmission member securely and comfortably at the entrance to the ear canal of the user, an earpiece, shell, or earmould may be provided for insertion into the ear canal of the user constituting an open solution. In an open solution, the earpiece, shell, or earmould does not obstruct the ear canal when it is positioned in its intended operational position in the ear canal. Rather, there will be a passageway through the earpiece, shell, or earmould or, between a part of the ear canal wall and a part of the earpiece, shell, or earmould, so that sound waves may escape from behind the earpiece, shell, or earmould between the ear drum and the earpiece, shell, or earmould through the passageway to the surroundings of the user. In this way, the occlusion effect is substantially eliminated.

Typically, the earpiece, shell, or earmould is individually custom manufactured or manufactured in a number of standard sizes to fit the user's ear to sufficiently secure the sound signal transmission member in its intended position in the ear canal and prevent the earpiece from falling out of the ear, e.g., when the user moves the jaw.

The output transducer may be a receiver positioned in the BTE hearing aid housing. In this event, the sound signal transmission member comprises a sound tube for propagation of acoustic sound signals from the receiver positioned in the BTE hearing aid housing and through the sound tube to an earpiece positioned and retained in the ear canal of the user and having an output port for transmission of the acoustic sound signal to the eardrum in the ear canal.

The output transducer may be a receiver positioned in the earpiece. In this event, the sound signal transmission member comprises electrical conductors for propagation of audio signals from the output of a processor in the BTE hearing aid housing through the conductors to a receiver positioned in the earpiece for emission of sound through an output port of the earpiece.

The ITE microphone housing accommodating at least one ITE microphone may be combined with, or be constituted by, the earpiece so that the at least one microphone is positioned proximate the entrance to the ear canal when the earpiece is fastened in its intended position in the ear canal.

The ITE microphone housing may be connected to the BTE hearing aid housing with an arm, possibly a flexible arm that is intended to be positioned inside the pinna, e.g. around the circumference of the conchae abutting the antihelix and at least partly covered by the antihelix for retaining its position inside the outer ear of the user. The arm may be pre-formed during manufacture, preferably into an arched shape with a curvature slightly larger than the curvature of the antihelix, for easy fitting of the arm into its intended position in the pinna. In one example, the arm has a length and a shape that facilitate positioning of the at least one ITE microphone in an operating position immediately below the triangular fossa.

The processor may be accommodated in the BTE hearing aid housing, or in the ear piece, or part of the processor may be accommodated in the BTE hearing aid housing and part of the processor may be accommodated in the ear piece. There is a one-way or two-way communication link between circuitry of the BTE hearing aid housing and circuitry of the earpiece. The link may be wired or wireless.

Likewise, there is a one-way or two-way communication link between circuitry of the BTE hearing aid housing and the at least one ITE microphone. The link may be wired or wireless.

The processor operates to perform hearing loss compensation while maintaining spatial information of the sound environment for optimum spatial performance of the hearing aid and while at the same time providing as large maximum stable gain as possible.

The output signal of the at least one ITE microphone of the earpiece may be a combination of several pre-processed ITE microphone signals, or the output signal of a single ITE microphone of the at least one ITE microphone. The short time spectrum for a given time instance of the output signal of the at least one ITE microphone of the earpiece is denoted $S^{IEC}(f,t)$ (IEC=In the Ear Component).

One or more output signals of the at least one BTE sound input transducers are provided. The spectra of these signals are denoted $S_1^{BTEC}(f,t)t)$, and $S_2^{BTEC}(f,t)$, etc (BTEC=Behind The Ear Component). The output signals may be pre-processed. Pre-processing may include, without excluding any form of processing; adaptive and/or static feedback suppression, adaptive or fixed beamforming and pre-filtering.

Adaptive cue filters may be configured to adaptively filter the audio signals of the at least one BTE sound input transducer so that they correspond to the output signal of the at least one ITE microphone as closely as possible. The adaptive cue filters $G_1, G_2, \ldots, G_n$ have the respective transfer functions: $G_1(f,t), G_2(f,t), \ldots, G_n(f,t)$.

The at least one ITE microphone may operate as monitor microphone(s) for generation of an audio signal with the desired spatial information of the current sound environment.

Each output signal of the at least one BTE sound input transducer is filtered with a respective adaptive cue filter, the filter coefficients of which are adapted to provide a combined output signal of the adaptive cue filter(s) that resembles the audio signal provided by the at least one ITE microphone as closely as possible.

The filter coefficients are adapted to obtain an exact or approximate solution to the following minimization problem:

$$\min_{G_1(f,t)\ldots G_n(f,t)} \| S^{IEC}(f,t) - G_1(f,t)S_1^{BTEC}(f,t) - \ldots - G_n(f,t)S_n^{BTEC}(f,t) \|^p \quad (1)$$

wherein p is the norm. Preferably p=2.

The algorithm controlling the adaption could (without being restricted to) e.g. be based on least mean square (LMS) or recursive least squares (RLS), possibly normalized, optimization methods in which p=2.

Various weights may be incorporated into the minimization problems above so that the solution is optimized as specified by the values of the weights. For example, frequency weights W(f) may optimize the solution in certain one or more frequency ranges while information in other frequency ranges may be disregarded. Thus, the minimization problem may be modified into:

$$\min_{G_1(f,t)\ldots G_n(f,t)} \| W(f)((S^{IEC}(f,t) - G_1(f,t)S_1^{BTEC}(f,t) - \ldots - G_n(f,t)S_n^{BTEC}(f,t)) \|^p \quad (2)$$

Further, in one or more selected frequency ranges, only magnitude of the transfer functions may be taken into account during minimization while phase is disregarded, i.e. in the one or more selected frequency range, the transfer function is substituted by its absolute value.

Subsequent to the adaptive cue filtering, the combined output signal of the adaptive cue filter(s) is passed on for further hearing loss compensation processing, e.g. with a compressor.

In this way, only signals from the at least one BTE sound input transducer is possibly amplified as a result of hearing loss compensation while the audio signal of the at least one ITE microphone is not included in the hearing loss compensation processing, whereby possible feedback from the output transducer to the at least one ITE microphone is reduced and a large maximum stable gain can be provided.

For example, in a hearing aid with one ITE microphone, and two BTE microphones constituting the at least one BTE sound input transducer, and in the event that the incident sound field consist of sound emitted by a single speaker, the emitted sound having the short time spectrum X(f,t); then, under the assumption that no pre-processing is performed with relation to the ITE microphone signal and that the ITE microphone reproduces the actual HRTF perfectly then the following signals are provided:

$$S^{IEC}(f,t)=\mathrm{HRTF}(f)X(f,t) \tag{3}$$

$$S_{1,2}^{BTEC}(f,t)=H_{1,2}(f)X(f,t) \tag{4}$$

where $H_{1,2}(f)$ are the hearing aid related transfer functions of the two BTE microphones.

After sufficient adaptation, the hearing aid impulse response convolved with the resulting adapted filters and summed will be equal the actual HRTF so that $$\lim_{t\to\infty} G_1(f,t)H_1(f)+G_2(f,t)H_2(f)=\mathrm{HRTF}(f) \tag{5}$$

If the speaker moves and thereby changes the HRTF, the adaptive cue filters, i.e. the algorithm adjusting the filter coefficients, adapt towards a new minimum of minimization problem (1) or (2) above. The time constants of the adaptation are set to appropriately respond to changes of the current sound environment.

Feedback is taken into account by monitoring feedback stability status and modifying adaptation of the adaptive cue filters in response to the feedback stability status. When no feedback is detected, the adaption of the adaptive cue filters operates to fulfil minimization problems (1) or (2) above.

In the event that the feedback stability status changes towards instability, the adaption of the adaptive cue filters is modified, e.g. the adaptation may be stopped, i.e. the filter coefficients may be prevented from changing, or the adaptation rate may be slowed down, in order to avoid that feedback is transferred from the audio signal of the at least one ITE microphone to the output signal(s) of the at least one BTE sound input transducer, when there is a high probability of feedback evolving in the hearing aid.

For example, adaptation may be stopped until the feedback stability status reverts to a stable condition. Further, the filter coefficients of the adaptive cue filters may be set to predetermined values while adaption of the filters is stopped.

When feedback stability status reverts to a stable condition, adaption is resumed with the current, possibly predetermined, values as starting values.

The filter coefficients of the adaptive cue filters may be changed gradually towards the predetermined fixed filter coefficients while adaption of the filters is stopped until the feedback stability status reverts to a stable condition and adaption can be resumed with the fixed, possibly predetermined, filter coefficients as starting values.

For example, the filter coefficients may be changed gradually according to:

$$w=(1-\beta)*w_{fixed}+\beta*w_{adaptive}$$

wherein w is the updated filter coefficients of the adaptive cue filters, $w_{fixed}$ is the fixed predetermined coefficients and $w_{adaptive}$ is the adaptive coefficients immediately before adaptation is stopped.

β may be a function (between 0 and 1) of a feedback status indicator. If β is 0, feedback problem is very severe and fixed coefficients are used to ensure stability. If β is 1, feedback is not a problem at all and the adaptive cue filters are adapted freely to achieve best spatial cue preservation in accordance with minimization problem (1) or (2) above.

An example of calculation of is given by $$\beta=\min\left(\frac{\|\hat{H}_{FB}-\overline{H}_{FB}\|_2^2}{\|\overline{H}_{FB}\|_2^2},\ 1\right)$$

where $\hat{H}_{FB}$ is the estimated feedback path response, e.g. from the output of the output transducer to the audio signal output by the at least one ITE microphone as modeled by a general adaptive feedback canceller, and $\overline{H}_{FB}$ is the corresponding initialized feedback path response.

The predetermined filter coefficients of the at least one adaptive cue filter may correspond to a specific HRTF.

The pre-determined sets of filter coefficients, one set for each predetermined HRTF, may be determined using a manikin, such as KEMAR. The filter coefficients are determined for at number of direction of arrivals for the hearing aid as disclosed above; however under controlled conditions and allowing adaptation of long duration. In this way, an approximation to the individual HRTFs is provided that can be of sufficient accuracy for the hearing aid user to maintain sense of direction when wearing the hearing aid.

During use, the set of pre-determined filter coefficients is selected that minimizes, or substantially minimizes, the difference between the combined output signal, possibly pre-processed, of the at least one BTE sound input transducer and the output signal, possibly pre-processed, of the at least one ITE microphone.

The at least one adaptive cue filter may be prevented from further adapting when the filter coefficient values have ceased changing significantly.

It should be noted that there are different methods of implementing the monitor algorithm and is not necessary based on a feedback canceller. The distance between the initialized feedback path and the estimated feedback path is only one possible feedback monitor algorithm. As an alternative, correlation between signals before processing in the hearing aid and a signal output by the hearing aid may be determined.

The transfer functions $H_{FB,1}^{BTEC}(f)$, $H_{FB,2}^{BTEC}(f)$, . . . , $H_{FB,n}^{BTEC}(f)$ of the feedback paths may be modelled or approximated by an adaptive feedback cancellation circuit well-known in the art.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

The hearing aid may be a multi-channel hearing aid in which signals to be processed are divided into a plurality of frequency channels, and wherein signals are processed individually in each of the frequency channels. The adaptive feedback cancellation circuitry may also be divided into the plurality of frequency channels; or, the adaptive feedback cancellation circuitry may still operate in the entire frequency range; or, may be divided into other frequency channels, typically fewer frequency channels, than the other circuitry is divided into.

The processor may be configured for processing the output signals of the at least one ITE microphone and the at least one BTE sound input transducer in such a way that the hearing loss compensated output signal substantially preserves spatial cues in a selected frequency band.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the processor of the hearing aid and may cooperate with the processor of the hearing aid in a well-known way.

In this way, the at least one ITE microphone supplies the input to the hearing aid at frequencies where the hearing aid is capable of supplying the desired gain with this configuration. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment provided by the at least one ITE microphone.

The hearing aid may for example comprise a first filter connected between the processor input and the at least one ITE microphone, and a second complementary filter connected between the processor input and a combined output of the at least one BTE sound input transducer, the filters passing and blocking frequencies in complementary frequency bands so that one of the at least one ITE microphone and the combined output of at least one BTE sound input transducer constitutes the main part of the input signal supplied to the processor input in one frequency band, and the other one of the at least one ITE microphone and the combined output of at least one BTE sound input transducer constitutes the main part of the input signal supplied to the processor input in the complementary frequency band.

In this way, the at least one ITE microphone may be used as the sole input source to the processor in a frequency band wherein the required gain for hearing loss compensation can be applied to the output signal of the at least one ITE microphone. Outside this frequency band, the combined output signal of the at least one BTE sound input transducer is applied to the processor for provision of the required gain.

The combination of the signals could e.g. be based on different types of band pass filtering.

A hearing aid includes: a BTE hearing aid housing configured to be worn behind a pinna of a user; at least one BTE sound input transducer accommodated in the BTE hearing aid housing, each of which is configured for conversion of acoustic sound into a respective audio signal; an ITE microphone housing configured to be positioned in an outer ear of the user; at least one ITE microphone accommodated in the ITE microphone housing, each of which is configured for conversion of acoustic sound into a respective audio signal; at least one adaptive cue filter, each of which having an input that is provided with an output from the at least one BTE sound input transducer, wherein filter coefficients of the at least one adaptive cue filter are adapted so that a difference between an output of the at least one ITE microphone and a combined output of the at least one adaptive cue filter is reduced; a processor configured to generate a hearing loss compensated output signal based on output by the at least one adaptive cue filter; an output transducer for conversion of the hearing loss compensated output signal to an auditory output signal that can be received by a human auditory system; an adaptive feedback canceller for feedback suppression, the adaptive feedback canceller connected to the processor for reception of the hearing loss compensated output signal, and configured to provide at least one output modelling a feedback path between the output transducer and the at least one BTE sound input transducer, wherein the adaptive feedback canceller is connected to a subtractor for subtraction of the at least one output modelling the feedback path from the output of the at least one BTE sound input transducer to obtain a difference, wherein the difference is outputted to the at least one adaptive cue filter; a feedback monitor connected to the adaptive feedback canceller and configured to monitor a state of feedback and having an output providing an indication of the state of feedback; and a cue controller connected to the feedback monitor and the at least one adaptive cue filter, and configured to control, in response to an output of the feedback monitor, the at least one adaptive cue filter so that the difference between the output of the at least one ITE microphone and the combined output of the at least one adaptive cue filter is reduced.

Optionally, the cue controller may be configured to lower a rate of adaptation of the at least one adaptive cue filter when a value of the output of the feedback monitor indicates feedback instability.

Optionally, the cue controller may be configured to stop adaptation of the at least one adaptive cue filter when a value of the output of the feedback monitor indicates feedback instability.

Optionally, the cue controller may be configured to stop adaptation of the at least one adaptive cue filter when a value of the output of the feedback monitor indicates feedback instability, and set the filter coefficients of the at least one adaptive cue filter to predetermined values.

Optionally, the cue controller may be configured to gradually change each of the filter coefficients of the at least one adaptive cue filter within a predetermined time period to a predetermined value when a value of the output of the feedback monitor indicates feedback instability.

Optionally, the cue controller may be configured to provide a value of a filter coefficient as a linear weighted sum of values of the filter coefficients.

Optionally, a weight involved in the linear weighted sum may be a function of an output value $\beta$ provided by the feedback monitor in response to feedback stability.

Optionally, the filter coefficients may comprise sets of predetermined filter coefficients, and the hearing aid may further comprise a memory for accommodation of the sets of the predetermined filter coefficients of the at least one adaptive cue filter, wherein one of the sets of the predetermined filter coefficients is determined for a specific direction of arrival with relation to the hearing aid.

Optionally, the at least one adaptive cue filter may be loaded with the set of predetermined filter coefficients that provides a minimum difference between the output of the at least one ITE microphone and the combined output of the at least one adaptive cue filter.

Optionally, the cue controller may be configured to resume adaptation of the at least one adaptive cue filter when a value of the output of the feedback monitor no longer indicates feedback instability.

Optionally, the at least one adaptive cue filter may be prevented from further adapting when changes of values of the filter coefficients are below a prescribed threshold.

Optionally, the audio signals from the BTE and the ITE may be divided into a plurality of frequency channels, and wherein the at least one adaptive cue filter may be configured for individually processing the audio signals in one or more of the frequency channels.

Optionally, the at least one BTE sound input transducer may be disconnected from the processor in one or more of the frequency channels so that hearing loss compensation is based solely on the output of the at least one ITE microphone.

Optionally, the hearing aid may further include: a sound signal transmission member for transmission of a sound signal from a sound output in the BTE hearing aid housing at a first end of the sound signal transmission member to the ear canal of the user at a second end of the sound signal transmission member; and an earpiece configured to be inserted in the ear canal of the user for fastening and retaining the sound signal transmission member in its intended position in the ear canal of the user.

Optionally, the cue controller may be configured to control, in response to the output of the feedback monitor, the at least one adaptive cue filter so that the difference between the output of the at least one ITE microphone and the combined output of the at least one adaptive cue filter is minimized.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
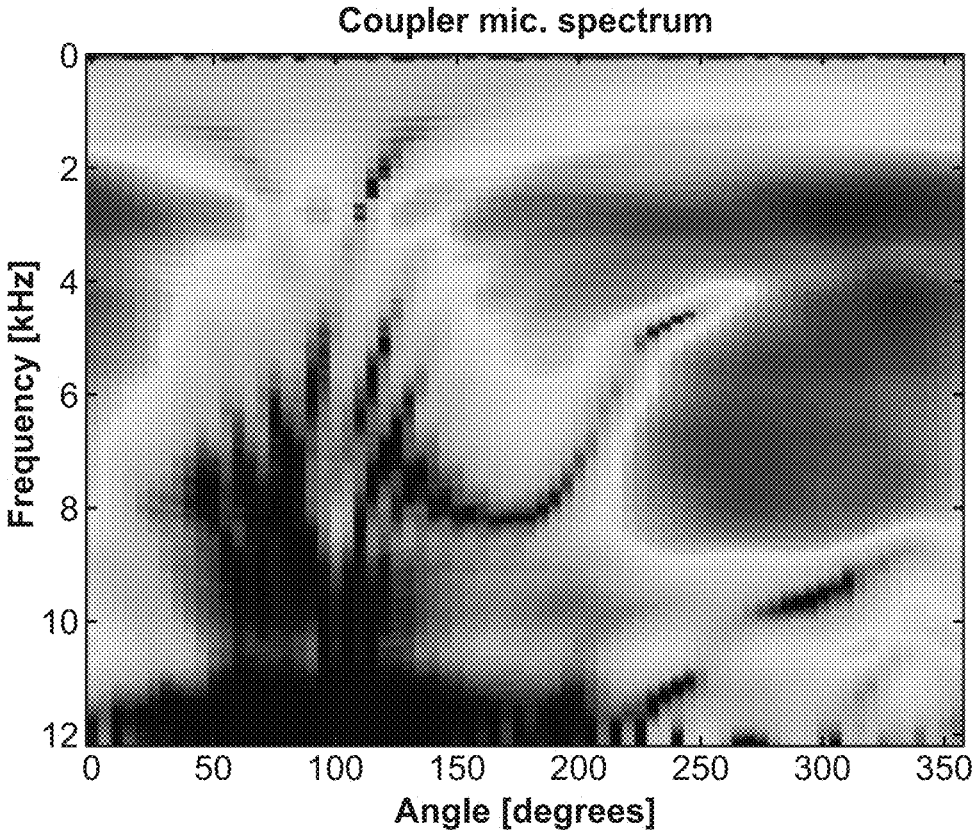
FIG. 1 shows a plot of the angular frequency spectrum of an open ear.
Figure 2:
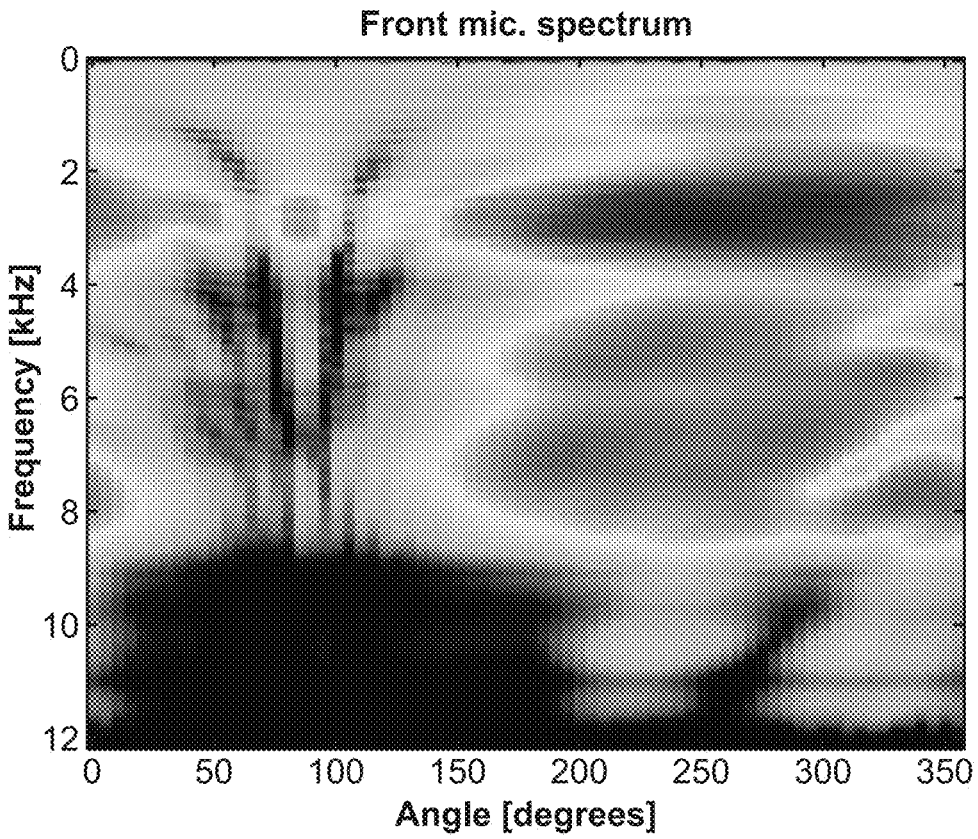
FIG. 2 shows a plot of the angular frequency spectrum of a BTE front microphone worn at the same ear.
Figure 3:
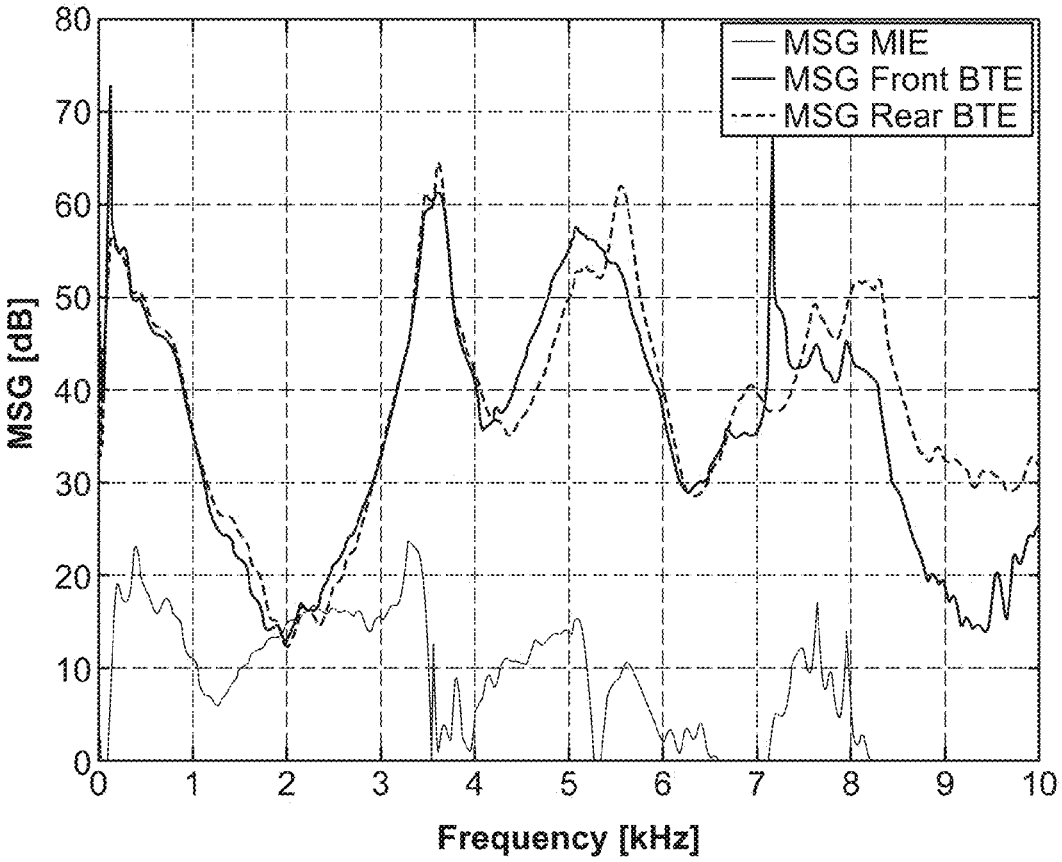
FIG. 3 shows plots of maximum stable gain of a BTE front and rear microphones and an open fitted ITE microphone positioned in the ear canal, FIG. 4 schematically illustrates an exemplary new hearing aid, FIG. 5 schematically illustrates another exemplary new hearing aid.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 4:
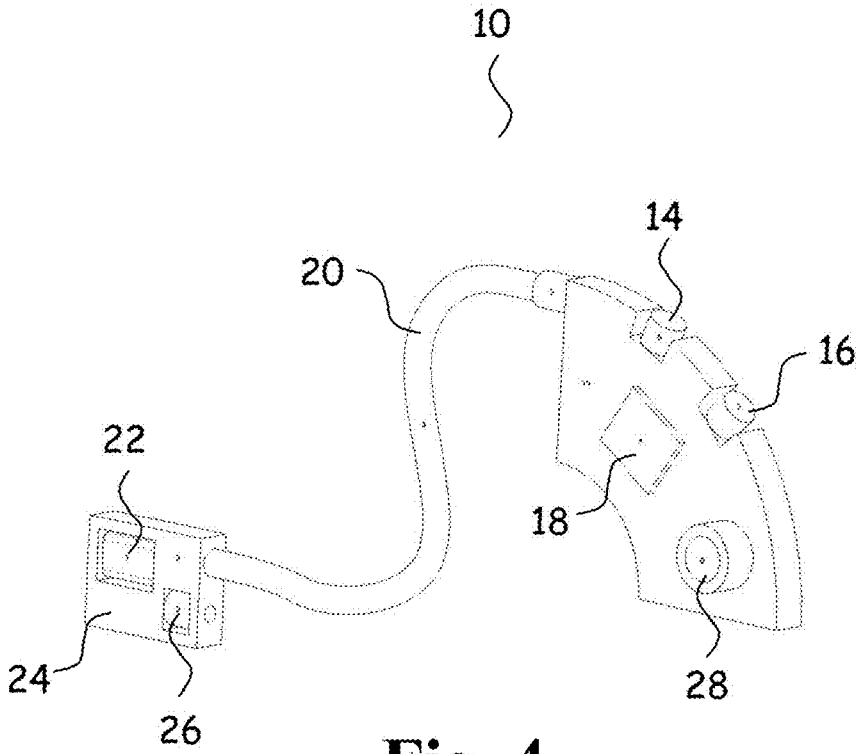

FIG. 4 schematically illustrates a BTE hearing aid 10 comprising a BTE hearing aid housing 12 (not shown—outer walls have been removed to make internal parts visible) to be worn behind the pinna 100 of a user. The BTE housing 12 accommodates at least one BTE sound input transducer 14, 16 with a front microphone 14 and a rear microphone 16 for conversion of a sound signal into a microphone audio signal, optional pre-filters (not shown) for filtering the respective microphone audio signals, A/D converters (not shown) for conversion of the respective microphone audio signals into respective digital microphone audio signals that are input to a processor 18 configured to generate a hearing loss compensated output signal based on the input digital audio signals.

The hearing loss compensated output signal is transmitted through electrical wires contained in a sound signal transmission member 20 to a receiver 22 for conversion of the hearing loss compensated output signal to an acoustic output signal for transmission towards the eardrum of a user and contained in an earpiece 24 that is shaped (not shown) to be comfortably positioned in the ear canal of a user for fastening and retaining the sound signal transmission member in its intended position in the ear canal of the user as is well-known in the art of BTE hearing aids.

The earpiece 24 also holds one ITE microphone 26 that is positioned at the entrance to the ear canal when the earpiece is positioned in its intended position in the ear canal of the user. The ITE microphone 26 is connected to an A/D converter (not shown) and optional to a pre-filter (not shown) in the BTE housing 12, with electrical wires (not visible) contained in the sound transmission member 20.

The BTE hearing aid 10 is powered by battery 28.

Various possible functions of the processor 18 are disclosed above and some of these in more detail below.

Figure 5:
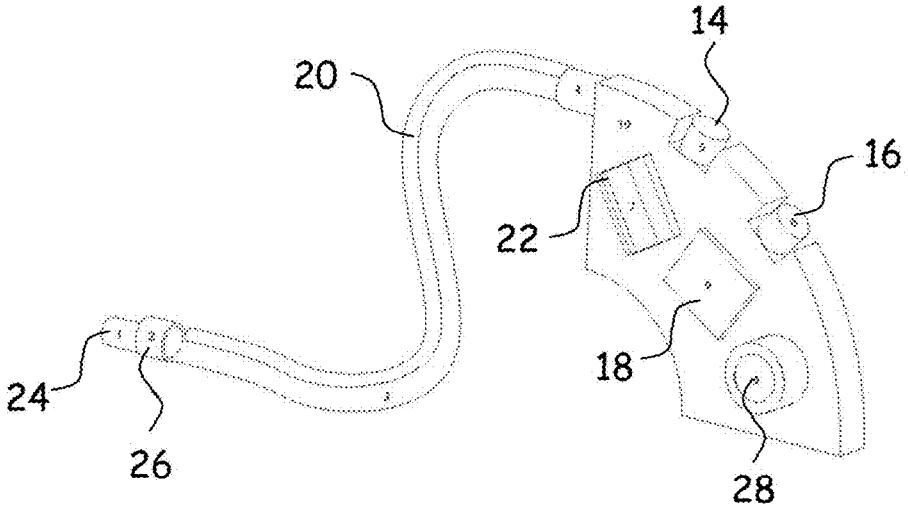

FIG. 5 schematically illustrates another BTE hearing aid 10 similar to the hearing aid shown in FIG. 1, except for the difference that in FIG. 5, the receiver 22 is positioned in the hearing aid housing 12 and not in the earpiece 24, so that acoustic sound output by the receiver 22 is transmitted through the sound tube 20 and towards the eardrum of the user when the earpiece 24 is positioned in its intended position in the ear canal of the user.

The positioning of the ITE microphone 26 proximate the entrance to the ear canal of the user when the BTE hearing aids 10 of FIGS. 4 and 5 are used is believed to lead to a good reproduction of the HRTFs of the user.

Figure 6:
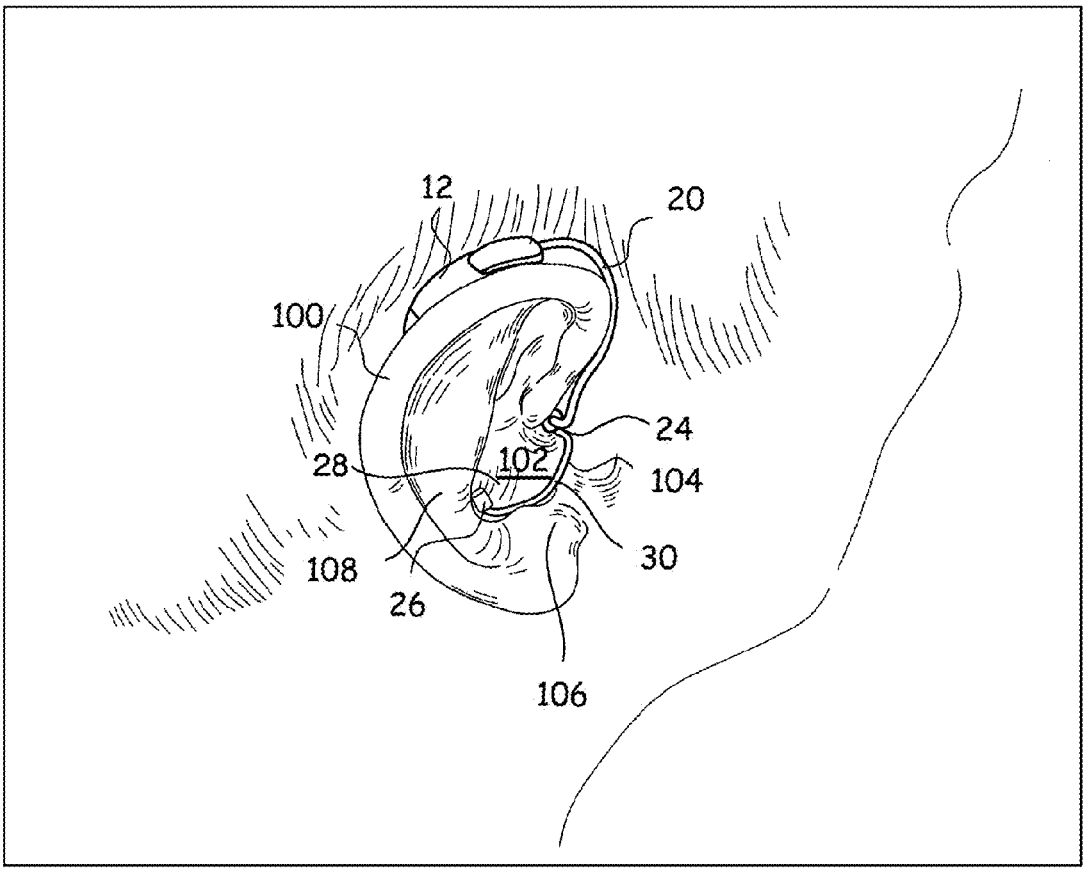
FIG. 6 shows in perspective a new hearing aid with an ITE-microphone in the outer ear of a user.

FIG. 6 shows a BTE hearing aid 10 in its operating position with the BTE housing 12 behind the ear, i.e. behind the pinna 100, of the user. The illustrated BTE hearing aid 10 is similar to the hearing aids shown in FIGS. 4 and 5 except for the fact that the ITE microphone 26 is positioned in the outer ear of the user outside the ear canal at the free end of an arm 30. The arm 30 is flexible and the arm 30 is intended to be positioned inside the pinna 100, e.g. around the circumference of the conchae 102 behind the tragus 104 and antitragus 106 and abutting the antihelix 108 and at least partly covered by the antihelix for retaining its position inside the outer ear of the user. The arm may be pre-formed during manufacture, preferably into an arched shape with a curvature slightly larger than the curvature of the antihelix 104, for easy fitting of the arm 30 into its intended position in the pinna. The arm 30 contains electrical wires (not visible) for interconnection of the ITE microphone 26 with other parts of the BTE hearing aid circuitry.

In one example, the arm 30 has a length and a shape that facilitate positioning of the ITE microphone 26 in an operating position below the triangular fossa.

Figure 7:
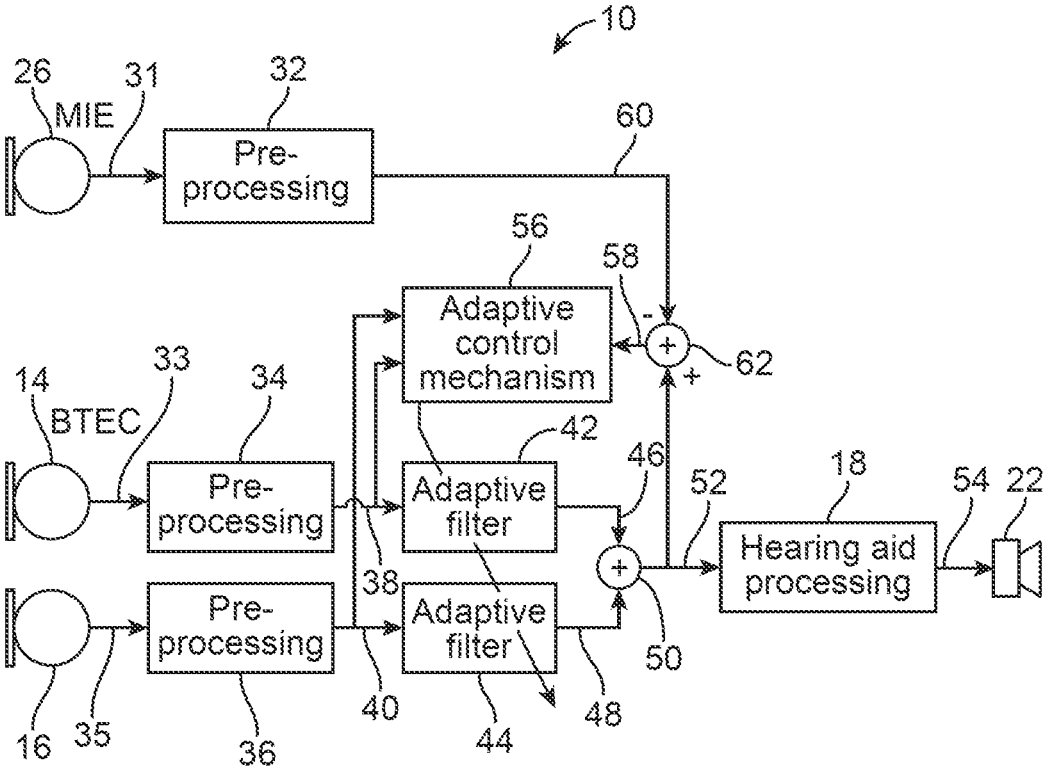
FIG. 7 shows a schematic block diagram of an exemplary new hearing aid with adaptive cue filters.

FIG. 7 is a block diagram illustrating one example of signal processing in the new hearing aid 10. The illustrated hearing aid 10 has a front microphone 14 and a rear microphone 16 accommodated in the hearing aid housing configured to be worn behind the pinna of the user, for conversion of sound signals arriving at the microphones 14, 16 into respective audio signals 33, 35. Further, the illustrated hearing aid 10 has an ITE microphone 26 accommodated in an earpiece (not shown) to be positioned in the outer ear of the user, for conversion of sound signals arriving at the microphone 26 into audio signal 31.

The microphone audio signals 31, 33, 35 are digitized and pre-processed, such as pre-filtered, in respective pre-processors 32, 34, 36. The pre-processed audio signals 38, 40 of the front and rear microphones 14, 16 are filtered in respective adaptive cue filters 42, 44, and the adaptively filtered signals 46, 48 are added to each other in adder 50 and the combined signal 52 is input to processor 18 for hearing loss compensation. The hearing loss compensated signal 54 is output to the receiver 22 that converts the signal 54 to an acoustic output signal for transmission towards the ear drum of the user.

Adaptation of the filter coefficients of adaptive cue filters 42, 44 are controlled by adaptive controller 56 that controls the adaptation of the filter coefficients to reduce, and preferably eventually minimize, the difference 58 between the output 52 of adder 46 and the pre-processed ITE microphone audio signal 60, output by subtractor 62. In this way, the input signal 52 to the processor 18 models the microphone audio signal 60 of the ITE microphone 26, and thus also substantially models the HRTFs of the user.

The pre-processed output signal 60 of the ITE microphone 26 of the earpiece has a short time spectrum denoted $S^{IEC}(f,t)$ (IEC=In the Ear Component).

The spectra of the pre-processed audio signals 38, 40 of the front and rear microphones 14, 16 are denoted $S_1^{BTEC}(f,t)$, and $S_2^{BTEC}(f,t)$ (BTEC=Behind The Ear Component). Pre-processing may include, without excluding any form of processing; adaptive and/or static feedback suppression, adaptive or fixed beamforming and pre-filtering.

The adaptive controller 56 is configured to control the filter coefficients of adaptive cue filters 42, 44 so that their summed output 52 corresponds to the pre-processed output signal 60 of the ITE microphone 26 as closely as possible.

The adaptive cue filters 42, 44 have the respective transfer functions: $G_1(f,t)$, and $G_2(f,t)$.

The ITE microphone 26 operates as monitor microphone for generation of an audio signal 60 with the desired spatial information of the current sound environment due to its positioning in the outer ear of the user.

Thus, the filter coefficients of the adaptive cue filters 42, 44 are adapted to obtain an exact or approximate solution to the minimization problem:

$$\min_{G_1(f,t),G_2(f,t)} \|S^{IEC}(f,t) - G_1(f,t)S_1^{BTEC}(f,t) - G_2(f,t)S_2^{BTEC}(f,t)\|^p \tag{11}$$

wherein p is the norm-factor.

Preferably p=2.

The algorithm controlling the adaption could (without being restricted to) e.g. be based on least mean square (LMS) or recursive least squares (RLS), possibly normalized, optimization methods in which p=2.

Subsequent to the adaptive cue filtering, the combined output signal 52 of the adaptive cue filters 42, 44 is passed on for further hearing loss compensation processing, e.g. in a compressor. In this way, only signals from the front and rear microphones 14, 16 are possibly amplified as a result of hearing loss compensation while the audio signal 60 of the ITE microphone 26 is not processed in the processor 18 configured for hearing loss processing, whereby possible feedback from the output transducer 22 to the ITE microphone 26 is reduced, and a large maximum stable gain can be provided.

For example, in the event that the incident sound field consists of sound emitted by a single speaker, the emitted sound having the short time spectrum X(f,t); then, under the assumption that no pre-processing is performed with relation to the ITE microphone signal 60 and that the ITE microphone 26 reproduces the actual HRTF perfectly then the following signals are provided:

$$S^{IEC}(f,t)=\mathrm{HRTF}(f)X(f,t) \tag{12}$$

$$S_{1,2}^{BTEC}(f,t)=H_{1,2}(f)X(f,t) \tag{13}$$

where $H_{1,2}(f)$ are the hearing aid related transfer functions of the two BTE microphones 14, 16.

After sufficient adaptation, the hearing aid impulse response convolved with the resulting adapted filters and summed will be equal the actual HRTF so that $$\lim_{t\to\infty} G_1(f,t)H_1(f)+G_2(f,t)H_2(f)=\mathrm{HRTF}(f) \tag{14}$$

If the speaker moves and thereby changes the actual HRTF, the adaptive cue filters 42, 44 adapt towards the new minimum of the minimization problem (11) controlled by the adaptive controller 56. The time constants of the adaptation are set to appropriately respond to changes of the current sound environment.

Sets of filter coefficients of the at least one adaptive cue filter may be predetermined corresponding to selected HRTFs so that a set of filter coefficients is provided for a specific HRTF. Pre-determined filter coefficients may be provided as a starting point for adaptation of the adaptive cue filters.

The sets of filter coefficients, one set for each predetermined HRTF, may be determined using a manikin, such as KEMAR. The filter coefficients are determined for at number of direction of arrivals for the hearing aid as disclosed above; however under controlled conditions and allowing adaptation of long duration. In this way, an approximation to the individual HRTFs is provided that can be of sufficient accuracy for the hearing aid user to maintain sense of direction when wearing the hearing aid.

During use, the set of filter coefficients is selected that minimizes, or substantially minimizes, the difference between the combined output signal, possibly pre-processed, of the at least one BTE sound input transducer and the output signal, possibly pre-processed, of the at least one ITE microphone. During use, the adaptive cue filter may be allowed to further adapt to the individual HRTF of the user in question. The adaptation may be stopped when the filter coefficients have become stable so that the at least one ITE microphone is no longer used for the HRTF in question.

The new hearing aid circuitry shown in FIG. 7 may operate in the entire frequency range of the hearing aid 10.

The hearing aid 10 shown in FIG. 7 may be a multi-channel hearing aid in which microphone audio signals 38, 40, 60 to be processed are divided into a plurality of frequency channels, and wherein signals are processed individually in each of the frequency channels.

For a multi-channel hearing aid 10, FIG. 7 may illustrate the circuitry and signal processing in a single frequency channel. The circuitry and signal processing may be duplicated in a plurality of the frequency channels, e.g. in all of the frequency channels.

For example, the signal processing illustrated in FIG. 7 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the ITE microphone 26 may be connected conventionally as an input source to the processor 18 of the hearing aid 10 and may cooperate with the processor 18 of the hearing aid 10 in a well-known way.

In this way, the ITE microphone supplies the input to the hearing aid at frequencies where the hearing aid is capable of supplying the desired gain with this configuration. In the selected frequency band, wherein the hearing aid cannot supply the desired gain with this configuration, the microphones 14, 16 of BTE hearing aid housing are included in the signal processing as disclosed above. In this way, the gain can be increased while the spatial information of the sound environment as provided by the ITE microphone is simultaneously maintained.

Figure 8:
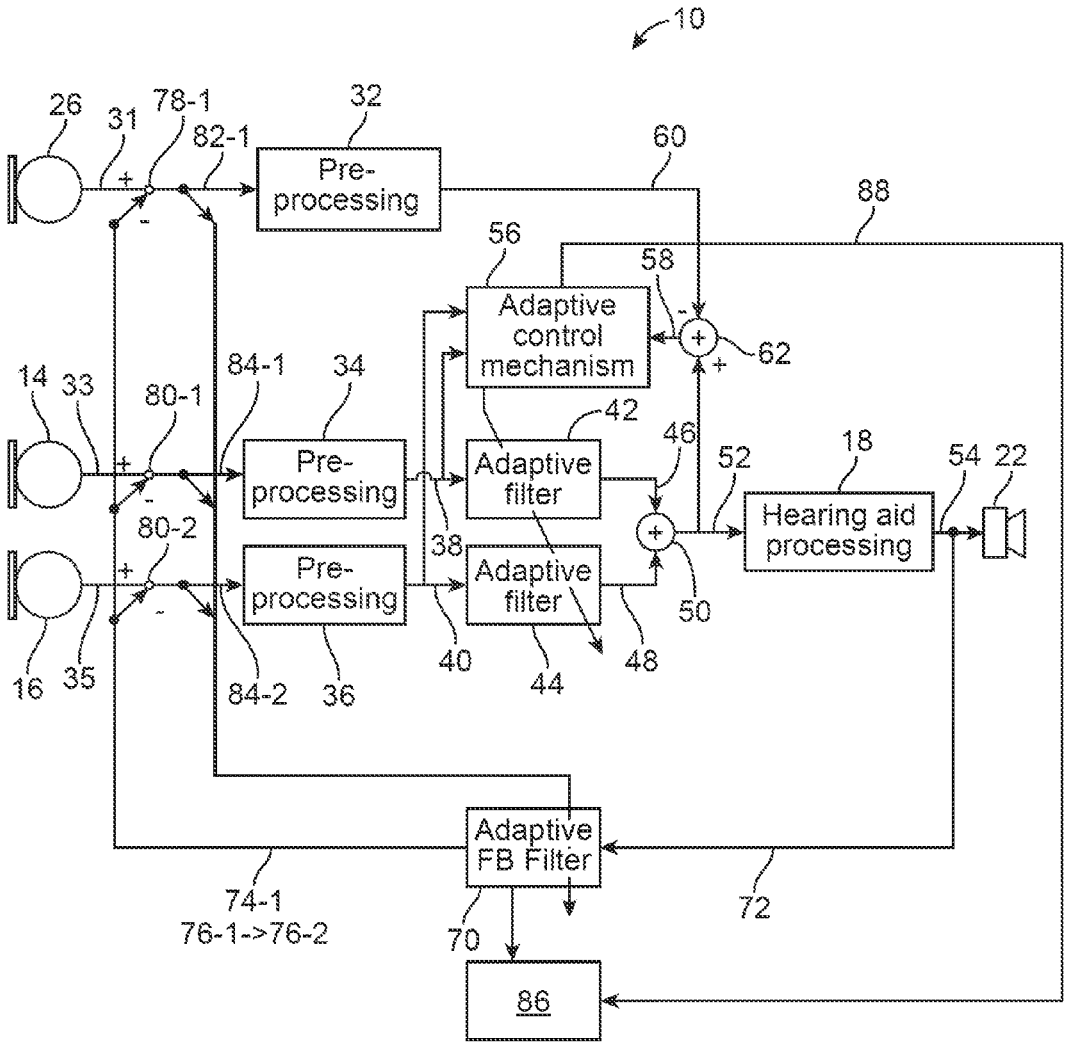
FIG. 8 shows a schematic block diagram of the hearing aid of FIG. 7 with added monitoring of feedback cancellation.

FIG. 8 is a block diagram illustrating a new hearing aid 10 similar to the hearing aid 10 shown in FIG. 7 except for the fact that adaptive feedback cancellation circuitry 70, 72, 74-1, 76-1, 76-2, 78-1, 80-1, 80-2, 82-1, 84-1, 84-2, 86 has been added, including an adaptive feedback filter 70 with an input 72 connected to the output of the hearing aid processor 18 and with individual outputs 74-1, 76-1, 76-2, each of which is connected to a respective subtractor 78-1, 80-1, 80-2 for subtraction of each output 74-1, 76-1, 76-2 from a respective microphone output 31, 33, 35 to provide a respective feedback compensated signal 82-1, 84-1, 84-2 as is well-known in the art. Each feedback compensated signal 82-1, 84-1, 84-2 is fed to the corresponding pre-processor 32, 34, 36, and also to the adaptive feedback filter 70 for control of the adaption of the adaptive feedback filter 70. The adaptive feedback filter outputs 74-1, 76-1, 76-2 provide signals that constitute approximations of corresponding feedback signals travelling from the output transducer 22 to the respective microphone 14, 16, 26 as is well-known in the art.

The adaptive controller 56 of FIG. 8 controls adjustment of the filter coefficients of adaptive cue filters 42, 44 as disclosed above with reference to FIG. 7, however as modified by feedback monitor signal 88 output by feedback monitor 86 in order to preserve spatial cue and simultaneously take feedback into account.

The feedback monitor 86 monitors the possible onset of feedback and outputs a feedback monitor signal 88 accordingly. The adaptive controller 56 receives the monitor signal 88 and modifies adaptation of the adaptive cue filters 42, 44 in response to the value of the monitor signal 88, i.e. in response to the feedback stability status. When no feedback is detected, the adaption of the adaptive cue filters operates to fulfil minimization problems (1) or (2) above.

In the event that the feedback stability status changes towards instability, the adaption of the adaptive cue filters 42, 44 is modified, e.g. the adaptation may be stopped, i.e. the filter coefficients of the adaptive cue filters 42, 44 may be prevented from changing, or the adaptation rate may be slowed down, in order to avoid that feedback is transferred from the audio signal 60 of the ITE microphone 26 to the output signal(s) of the at least one BTE sound input transducer, when there is a high probability of feedback evolving in the hearing aid.

For example, adaptation may be stopped until the feedback stability status reverts to a stable condition. Further, the filter coefficients of the adaptive cue filters 42, 44 may be set to predetermined values while adaption of the filters is stopped.

When feedback stability status reverts to a stable condition, adaption is resumed with the current, possibly predetermined, values of the filter coefficients as starting values.

The filter coefficients of the adaptive cue filters 42, 44 may be changed gradually towards the predetermined fixed filter coefficients while adaption of the filters is stopped until the feedback stability status reverts to a stable condition and adaption can be resumed with the fixed, possibly predetermined, filter coefficients as starting values.

For example, the filter coefficients may be changed gradually according to:

$$w=(1-\beta)*w_{fixed}+\beta*w_{adaptive}$$

wherein w is the updated filter coefficients of the adaptive cue filters, $w_{fixed}$ is the fixed predetermined coefficients and $w_{adaptive}$ is the adaptive coefficients immediately before adaptation is stopped.

β may be a function (between 0 and 1) of a feedback status indicator. If β is 0, feedback problem is very severe and fixed coefficients are used to ensure stability. If β is 1, feedback is not a problem at all and the adaptive cue filters are adapted freely to achieve best spatial cue preservation in accordance with minimization problem (1) or (2) above.

An example of calculation of is given by $$\beta = \min\left(\frac{\|\hat{H}_{FB} - \overline{H}_{FB}\|_2^2}{\|\overline{H}_{FB}\|_2^2}, 1\right)$$

where $\hat{H}_{FB}$ is the estimated feedback path response, e.g. from the output of the output transducer 22 to the audio signal 60 output by the ITE microphone 26 as modeled by adaptive feedback canceller 70, and $\overline{H}_{FB}$ is the corresponding initialized feedback path response.

The predetermined filter coefficients of the at least one adaptive cue filter may correspond to a specific HRTF.

The pre-determined sets of filter coefficients, one set for each predetermined HRTF, may be determined using a manikin, such as KEMAR. The filter coefficients are determined for at number of direction of arrivals for the hearing aid as disclosed above; however under controlled conditions and allowing adaptation of long duration. In this way, an approximation to the individual HRTFs is provided that can be of sufficient accuracy for the hearing aid user to maintain sense of direction when wearing the hearing aid.

During use, the set of pre-determined filter coefficients is selected that minimizes, or substantially minimizes, the difference between the combined output signal, possibly pre-processed, of the at least one BTE sound input transducer and the output signal, possibly pre-processed, of the at least one ITE microphone.

The at least one adaptive cue filter may be prevented from further adapting when the filter coefficient values have ceased changing significantly.

The new hearing aid circuitry shown in FIG. 8 may operate in the entire frequency range of the hearing aid 10.

Similar to the hearing aid shown in FIG. 7, the hearing aid 10 shown in FIG. 8 may be a multi-channel hearing aid in which microphone audio signals 38, 40, 60 to be processed are divided into a plurality of frequency channels, and wherein signals are processed individually in each of the frequency channels possibly apart from the adaptive feedback cancellation circuitry 70, 72, 74-1, 76-1, 76-2, 78-1, 80-1, 80-2, 82-1, 84-1, 84-2, 86 that may still operate in the entire frequency range; or, may be divided into other frequency channels, typically fewer frequency channels than the remaining illustrated circuitry.

For a multi-channel hearing aid 10, the part of FIG. 8 corresponding to the circuitry of FIG. 7 may illustrate the circuitry and signal processing in a single frequency channel, while the adaptive circuitry that may still operate in the entire frequency range; or, may be divided into other frequency channels, typically fewer frequency channels than the remaining illustrated circuitry.

The circuitry and signal processing, possibly apart from the adaptive feedback cancellation circuitry 70, 72, 74-1, 76-1, 76-2, 78-1, 80-1, 80-2, 82-1, 84-1, 84-2, 86, may be duplicated in a plurality of the frequency channels, e.g. in all of the frequency channels.

For example, the signal processing illustrated in FIG. 8, possibly apart from the adaptive feedback cancellation circuitry 70, 72, 74-1, 76-1, 76-2, 78-1, 80-1, 80-2, 82-1, 84-1, 84-2, 86, may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the processor of the hearing aid and may cooperate with the processor of the hearing aid in a well-known way.

In this way, the at least one ITE microphone supplies the input to the hearing aid at frequencies where the hearing aid is capable of supplying the desired gain with this configuration. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment provided by the at least one ITE microphone.

Figure 9:
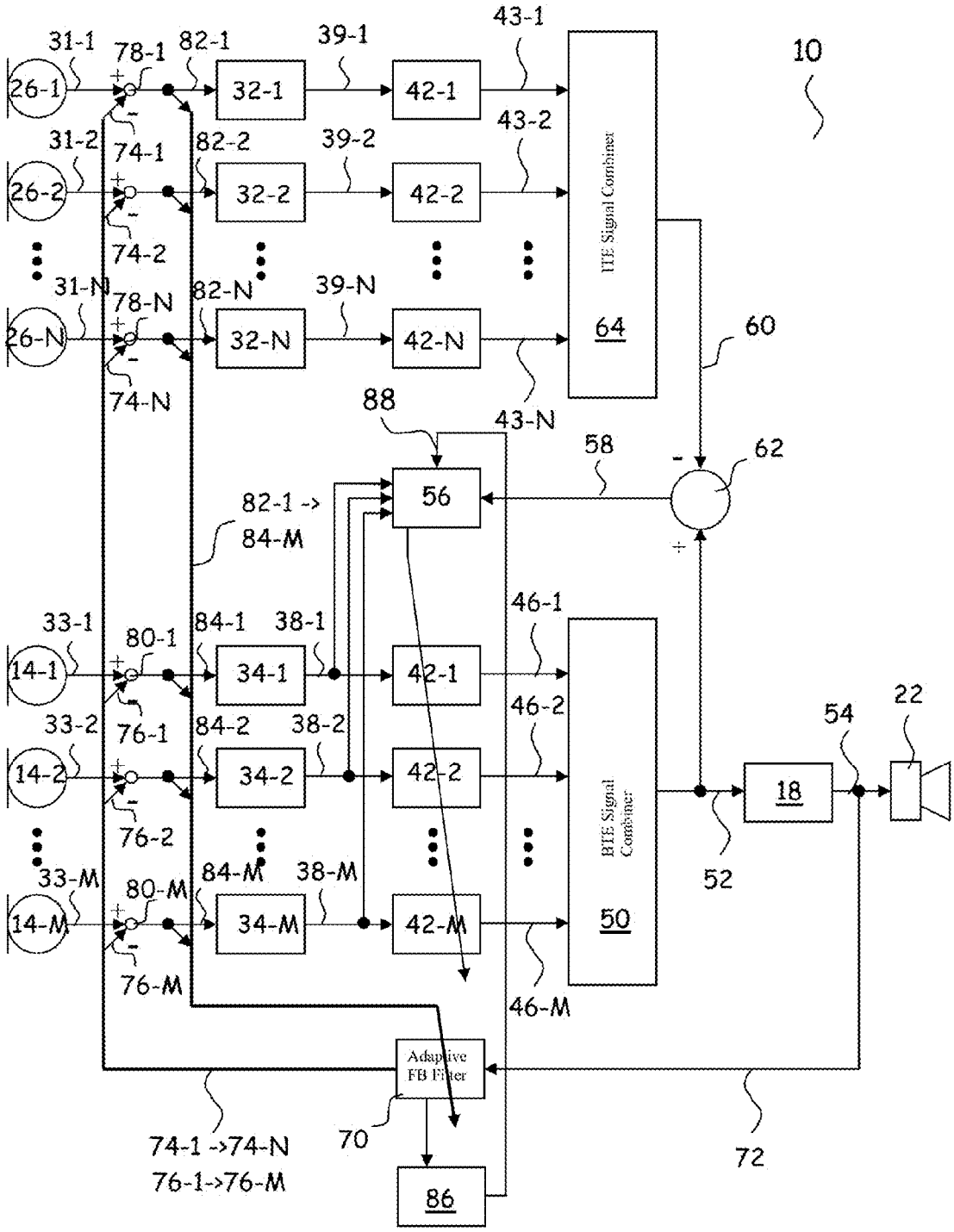
FIG. 9 shows a schematic block diagram of an exemplary new hearing aid with an arbitrary number of microphones.

FIG. 9 is a block diagram illustrating a new hearing aid 10 similar to the hearing aid 10 shown in FIG. 7 and operating in the same way, except for the fact that the circuit has been generalized to include an arbitrary number N of ITE microphones 26-1, 26-2, . . . , 26-N, and an arbitrary number M of BTE microphones 14-1, 14-2, . . . , 14-M. In FIG. 7, N=1 and M=2. In FIG. 9, N and M can be any non-negative integer.

The output signals 31-1, 31-2, . . . , 31-N from the N ITE microphones 26-1, 26-2, . . . , 26-N are delayed by delays 41-1, 41-2, . . . , 41-N after pre-processing in pre-processors 32-1, 32-2, . . . , 32-N to compensate for the delays of the output signals 33-1, 33-2, . . . , 33-M from the M BTE microphones 14-1, 14-2, . . . , 14-M, caused by the adaptive cue filters 42-1, 42-2, . . . , 42-M. The delays 41-1, 41-2, . . . , 41-N may also be used for beamforming. The output signals 31-1, 31-2, . . . , 31-N from the N ITE microphones 26-1, 26-2, . . . , 26-N are further combined in the signal combiner 64, e.g. as a weighted sum, and the output 60 of the signal combiner 64 is fed to a subtractor 62 as in the circuit shown in FIG. 7.

Likewise, the output signals 33-1, 33-2, . . . , 33-M from the M BTE microphones are pre-processed in pre-processors 34-1, 34-2, . . . , 34-M and filtered in the respective adaptive cue filters 42-1, 42-2, . . . , 42-M and combined in the signal combiner 50, e.g. as a weighted sum, and the output 52 of the signal combiner 50 is fed to the subtractor 62 and the hearing aid processor 18 as in the circuit of FIG. 7.

The adaptive controller 56 controls the adaptation of the filter coefficients of adaptive cue filters 42-1, 42-2, . . . , 42-M to reduce, and preferably eventually minimize or substantially minimize, the difference 58 between the output of BTE signal combiner 50 and ITE signal combiner 64, provided by subtractor 62, e.g. by solving the minimization problem (2) already mentioned above:

$$\min_{G_1(f,t)\ldots G_n(f,t)} \|W(f)((S^{IEC}(f,t)-G_1(f,t)S_1^{BTEC}(f,t)-\ldots-G_m(f,t)S_m^{BTEC}(f,t))\|^p$$

Wherein $S^{IEC}$ is the output signal 60 of signal combiner 64, and $G_1(f,t)$, $G_2(f,t)$, . . . , $G_n(f,t)$ are the transfer functions of the respective adaptive cue filters 42-1, 42-2, . . . , 42-M.

Typically p=2, and/or W(f)=1.

Possible weights in the signal combination performed by the signal combiner 58 are included in the transfer functions $G_1(f,t)$, $G_2(f,t)$, . . . , $G_n(f,t)$. These weights may be frequency dependent.

In this way, the output signal 52 of the BTE signal combiner 50 models the combined ITE microphone audio signal 60 of the ITE microphones 26-1, 26-2, . . . , 26-N, and thus also substantially models the HRTFs of the user.

The adaptive controller 56 of FIG. 9 controls adjustment of the filter coefficients of adaptive cue filters 42-1, 43-2, . . . , 42-M, however as modified by feedback monitor signal 88 output by feedback monitor 86 in a way similar to the way disclosed above with reference to FIG. 8, in order to preserve spatial cue and simultaneously take feedback into account.

The feedback monitor 86 monitors the possible onset of feedback and outputs a feedback monitor signal 88 accordingly. The adaptive controller 56 receives the monitor signal 88 and modifies adaptation of the adaptive cue filters 42-1, 43-2, . . . , 42-M in response to the value of the monitor signal 88, i.e. in response to the feedback stability status. When no feedback is detected, the adaption of the adaptive cue filters operates to fulfil minimization problems (1) or (2) above.

In the event that the feedback stability status changes towards instability, the adaption of the adaptive cue filters 42-1, 43-2, . . . , 42-M is modified, e.g. the adaptation may be stopped, i.e. the filter coefficients of the adaptive cue filters 42-1, 43-2, . . . , 42-M may be prevented from changing, or the adaptation rate may be slowed down, in order to avoid that feedback is transferred from the audio signal 60 of the at least one ITE microphone 26-1, 26-2, . . . , 26-N to the output signal(s) 33-1, 33-2, . . . , 33-M of the at least one BTE sound input transducer 14-1, 15-2, . . . , when there is a high probability of feedback evolving in the hearing aid.

For example, adaptation may be stopped until the feedback stability status reverts to a stable condition. Further, the filter coefficients of the adaptive cue filters 42-1, 43-2, . . . , 42-M may be set to predetermined values while adaption of the filters is stopped.

When feedback stability status reverts to a stable condition, adaption is resumed with the current, possibly predetermined, values of the filter coefficients as starting values.

The filter coefficients of the adaptive cue filters 42-1, 43-2, . . . , 42-M may be changed gradually towards the predetermined fixed filter coefficients while adaption of the filters is stopped until the feedback stability status reverts to a stable condition and adaption can be resumed with the fixed, possibly predetermined, filter coefficients as starting values.

For example, the filter coefficients may be changed gradually according to:

$$w=(1-\beta)*w_{fixed}+\beta*w_{adaptive}$$

wherein w is the updated filter coefficients of the adaptive cue filters, $w_{fixed}$ is the fixed predetermined coefficients and $w_{adaptive}$ is the adaptive coefficients immediately before adaptation is stopped.

β may be a function (between 0 and 1) of a feedback status indicator. If β is 0, feedback problem is very severe and fixed coefficients are used to ensure stability. If β is 1, feedback is not a problem at all and the adaptive cue filters are adapted freely to achieve best spatial cue preservation in accordance with minimization problem (1) or (2) above.

An example of calculation of is given by $$\beta = \min\left(\frac{\|\hat{H}_{FB} - \overline{H}_{FB}\|_2^2}{\|\overline{H}_{FB}\|_2^2}, 1\right)$$

where $\hat{H}_{FB}$ is the estimated feedback path response, e.g. from the output 54 of the processor 18 to the audio signal 60 output by the at least one ITE microphone 26-1, 26-2, . . . , 26-N as modeled by adaptive feedback canceller 70, and $\overline{H}_{FB}$ is the corresponding initialized feedback path response.

The predetermined filter coefficients of the at least one adaptive cue filter 42-1, 43-2, . . . , 42-M may correspond to a specific HRTF.

The pre-determined sets of filter coefficients, one set for each predetermined HRTF, may be determined using a manikin, such as KEMAR. The filter coefficients are determined for at number of direction of arrivals for the hearing aid as disclosed above; however under controlled conditions and allowing adaptation of long duration. In this way, an approximation to the individual HRTFs is provided that can be of sufficient accuracy for the hearing aid user to maintain sense of direction when wearing the hearing aid.

During use, the set of pre-determined filter coefficients is selected that minimizes, or substantially minimizes, the difference between the combined output signal, possibly pre-processed, of the at least one BTE sound input transducer and the output signal, possibly pre-processed, of the at least one ITE microphone.

The at least one adaptive cue filter may be prevented from further adapting when the filter coefficient values have ceased changing significantly.

The new hearing aid circuitry shown in FIG. 9 may operate in the entire frequency range of the hearing aid 10.

The hearing aid 10 shown in FIG. 9 may be a multi-channel hearing aid in which microphone audio signals 31-1, 31-2, . . . , 31-N, 33-1, 33-2, . . . , 33-M to be processed are divided into a plurality of frequency channels, and wherein signals are processed individually in each of the frequency channels possibly apart from the adaptive feedback cancellation circuitry 70, 72, 74-1, 74-2, . . . , 74-N, 76-1, 76-2, . . . , 76-M, 78-1, 78-2, . . . , 78-N, 80-1, 80-2, . . . , 80-M, 82-1, 82-2, . . . , 82-N, 84-1, 84-2, . . . , 84-M, 86 that may still operate in the entire frequency range; or, may be divided into other frequency channels, typically fewer frequency channels than the remaining illustrated circuitry.

For a multi-channel hearing aid 10, the part of FIG. 9 corresponding to the circuitry of FIG. 7 may illustrate the circuitry and signal processing in a single frequency channel, while the adaptive circuitry that may still operate in the entire frequency range; or, may be divided into other frequency channels, typically fewer frequency channels than the other illustrated circuitry The illustrated circuitry and signal processing may be duplicated in a plurality of the frequency channels, e.g. in all of the frequency channels.

For example, the signal processing illustrated in FIG. 9, possibly apart from the adaptive feedback cancellation circuitry 70, 72, 74-1, 74-2, . . . , 74-N, 76-1, 76-2, . . . , 76-M, 78-1, 78-2, . . . , 78-N, 80-1, 80-2, . . . , 80-M, 82-1, 82-2, . . . , 82-N, 84-1, 84-2, . . . , 84-M, 86, may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone 26-1, 26-2, . . . , 26-N may be connected conventionally as an input source to the processor 18 of the hearing aid 10 and may cooperate with the processor 18 of the hearing aid 10 in a well-known way.

In this way, the at least one ITE microphone 26-1, 26-2, . . . , 26-N supply the input to the hearing aid at frequencies where the hearing aid is capable of supplying the desired gain with this configuration. In the selected frequency band, wherein the hearing aid cannot supply the desired gain with this configuration, the microphones 14-1, 14-2, . . . , 14-M of BTE hearing aid housing are included in the signal processing as disclosed above. In this way, the gain can be increased while simultaneously maintain the spatial information about the sound environment provided by the at least one ITE microphone.

Figure 10:
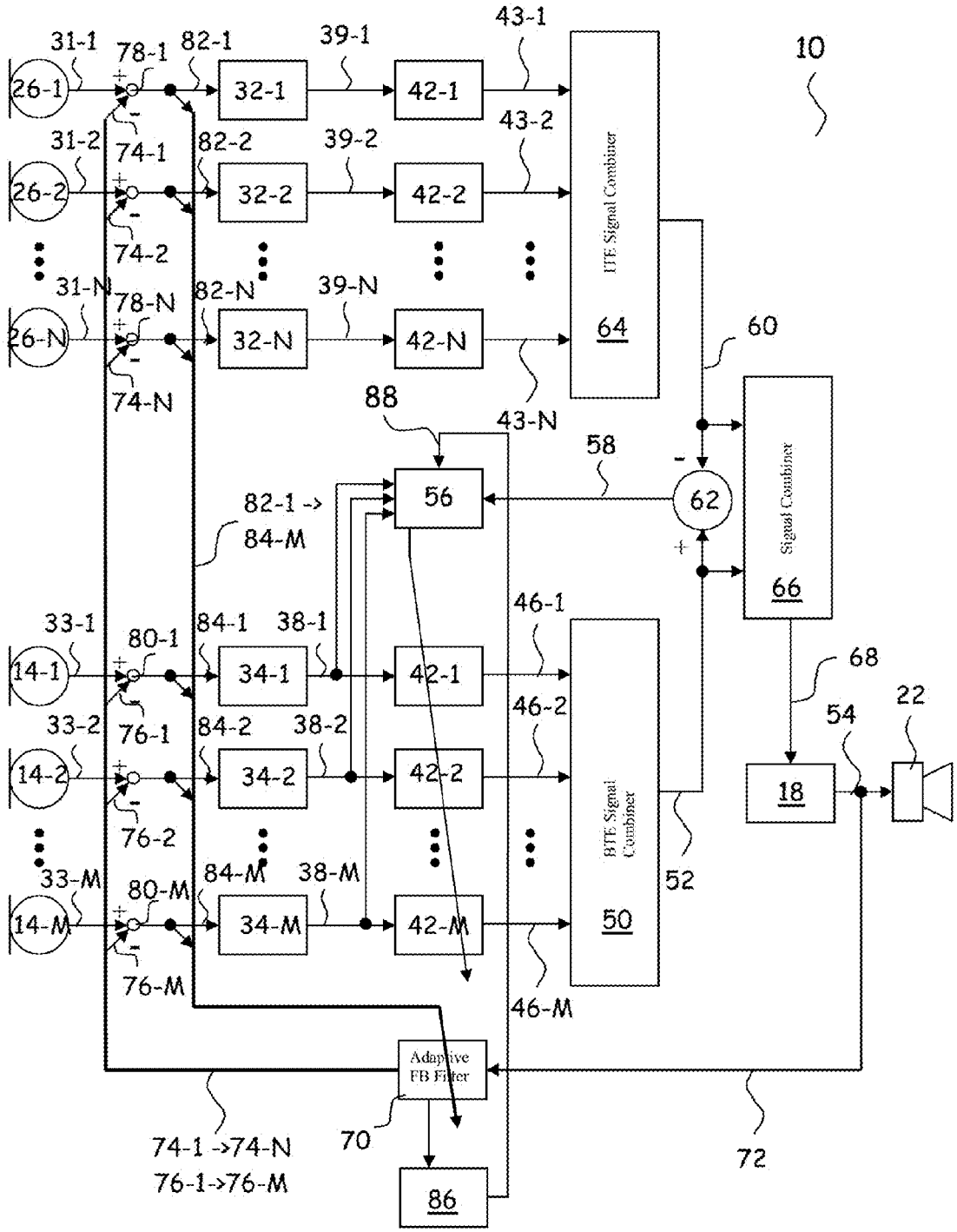
FIG. 10 shows a schematic block diagram of the hearing aid of FIG. 9 with added signal combination.

The hearing aid 10 shown in FIG. 10 is similar to the hearing aid 10 shown in FIG. 9 and operates in the same way, apart from the fact that, in FIG. 10, a signal combiner 66 has been inserted in front of the processor 18. The added signal combiner 66 comprises first filters connected between the processor input and the output 60 of the signal combiner 64 of the at least one ITE microphone 26-1, 26-2, . . . , 26-N, and second complementary filters connected between the processor input and the output 52 of the signal combiner 50 of the at least one BTE microphone 14-1, 14-2, . . . , 14-M, the filters passing and blocking, respectively, frequencies in complementary frequency bands so that the output 60 of the signal combiner 64 of the at least one ITE microphone 26-1, 26-2, . . . , 26-N constitutes the main part of the input signal 68 supplied to the processor input in one or more first frequency bands, and the output 52 of the signal combiner 50 of the at least one BTE microphone 14-1, 14-2, . . . , 14-M constitutes the main part of the input signal 68 supplied to the processor input in one or more complementary second frequency bands.

In this way, the at least one ITE microphone 26-1, 26-2, . . . , 26-N may be used as the sole input source to the processor 18 in one or more frequency bands wherein the required gain for hearing loss compensation can be applied to the output signal 60 of the at least one ITE microphone 26-1, 26-2, . . . , 26-N. Outside these one or more frequency bands, the combined output signal 52 of the at least one BTE sound input transducer 14-1, 14-2, . . . , 14-M is applied to the signal processor 18 for provision of the required gain.

The combination of the signals performed in signal combiner 66 could e.g. be based on different types of band pass filtering.

Similar to the hearing aid shown in FIG. 9, the hearing aid 10 shown in FIG. 10 may be a multi-channel hearing aid in which microphone audio signals 31-1, 31-2, . . . , 31-N, 33-1, 33-2, . . . , 33-M to be processed are divided into a plurality of frequency channels, and wherein signals are processed individually in each of the frequency channels possibly apart from the adaptive feedback cancellation circuitry 70, 72, 74-1, 74-2, . . . , 74-N, 76-1, 76-2, . . . , 76-M, 78-1, 78-2, . . . , 78-N, 80-1, 80-2, . . . , 80-M, 82-1, 82-2, . . . , 82-N, 84-1, 84-2, . . . , 84-M, 86 that may still operate in the entire frequency range; or, may be divided into other frequency channels, typically fewer frequency channels than the remaining illustrated circuitry. The signal combiner 66 may connect the audio signal 60 of the at least one ITE microphone 26-1, 26-2, . . . , 26-N as the sole input source to the processor 18 in one or more frequency channels in which no feedback instability has been detected by the feedback monitor 86, and the combined output signal 52 of the at least one BTE sound input transducer 14-1, 14-2, . . . , 14-M in frequency channels with risk of feedback as detected by the feedback monitor 86.

Figure 11:
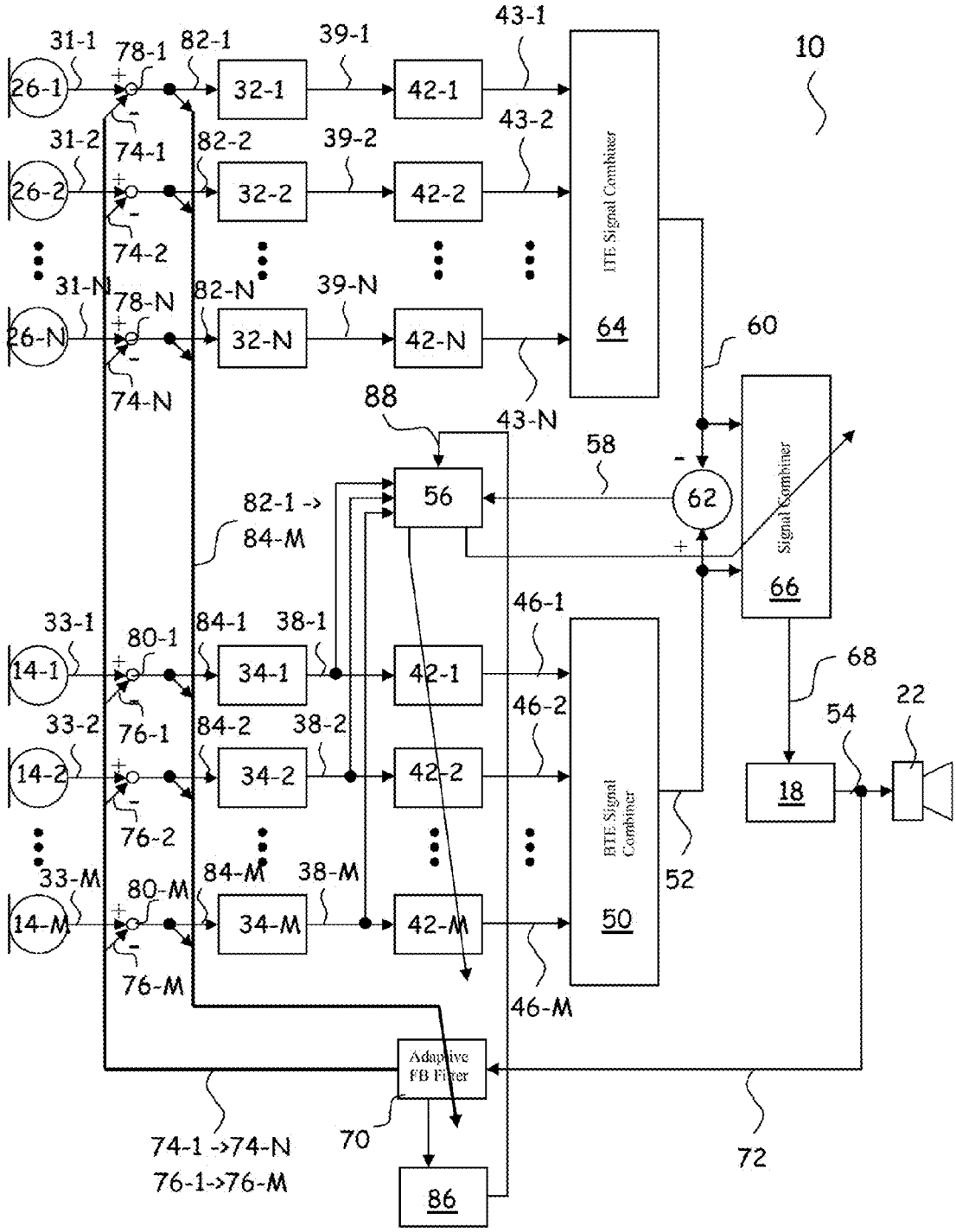
FIG. 11 shows a schematic block diagram of the hearing aid of FIG. 9 with added adaptive signal combination.

The hearing aid 10 shown in FIG. 11 is similar to the hearing aid 10 shown in FIG. 10 and operates in the same way, apart from the fact that, in FIG. 11, the signal combiner 66 is adaptive, e.g. so that the interconnections of the output 60 of the signal combiner 64 of the at least one ITE microphone 26-1, 26-2, . . . , 26-N and the output 52 of the signal combiner 50 of the at least one BTE microphone 14-1, 14-2, . . . , 14-M can be changed during operation of the hearing aid 10, e.g. in response to the status of feedback, whereby, the at least one ITE microphone 26-1, 26-2, . . . , 26-N may be used as the sole input source to the processor 18 in one or more frequency bands in which no feedback is currently present or emerging, whereas in one or more frequency bands in which feedback is present or evolving, the combined output signal 52 of the at least one BTE sound input transducer 14-1, 14-2, . . . , 14-M is applied to the signal processor 18 for provision of the required gain without feedback.

Similar to the hearing aid shown in FIG. 10, the hearing aid 10 shown in FIG. 11 may be a multi-channel hearing aid in which microphone audio signals 31-1, 31-2, . . . , 31-N, 33-1, 33-2, . . . , 33-M to be processed are divided into a plurality of frequency channels, and wherein signals are processed individually in each of the frequency channels possibly apart from the adaptive feedback cancellation circuitry 70, 72, 74-1, 74-2, . . . , 74-N, 76-1, 76-2, . . . , 76-M, 78-1, 78-2, . . . , 78-N, 80-1, 80-2, . . . , 80-M, 82-1, 82-2, . . . , 82-N, 84-1, 84-2, . . . , 84-M, 86 that may still operate in the entire frequency range; or, may be divided into other frequency channels, typically fewer frequency channels than the remaining illustrated circuitry. The signal combiner 66 may adaptively connect the audio signal 60 of the at least one ITE microphone 26-1, 26-2, . . . , 26-N as the sole input source to the processor 18 in one or more frequency channels in which no feedback instability is currently detected by the feedback monitor 86, and the combined output signal 52 of the at least one BTE sound input transducer 14-1, 14-2, . . . , 14-M in frequency channels with current risk of feedback as detected by the feedback monitor 86.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a behind-the-ear (BTE) hearing aid housing configured to be worn behind a pinna of a user;

at least one BTE sound input transducer accommodated in the BTE hearing aid housing, each of which is configured for conversion of acoustic sound into a respective audio signal;

an in-the-ear (ITE) microphone housing configured to be positioned in an outer ear of the user;

at least one ITE microphone accommodated in the ITE microphone housing, each of which is configured for conversion of acoustic sound into a respective audio signal;

at least one adaptive cue filter, each of which having an input that is provided with an output from the at least one BTE sound input transducer, wherein filter coefficients of the at least one adaptive cue filter are adapted so that a difference between an output of the at least one ITE microphone and a combined output of the at least one adaptive cue filter is reduced;

a processor configured to generate a hearing loss compensated output signal based on output by the at least one adaptive cue filter;

an output transducer for conversion of the hearing loss compensated output signal to an auditory output signal that can be received by a human auditory system;

an adaptive feedback canceller for feedback suppression, the adaptive feedback canceller connected to the processor for reception of the hearing loss compensated output signal, and configured to provide at least one output modelling a feedback path between the output transducer and the at least one BTE sound input transducer, wherein the adaptive feedback canceller is connected to a subtractor for subtraction of the at least one output modelling the feedback path from the output of the at least one BTE sound input transducer to obtain a difference, wherein the difference is outputted to the at least one adaptive cue filter;

a feedback monitor connected to the adaptive feedback canceller and configured to monitor a state of feedback and having an output providing an indication of the state of feedback; and a cue controller connected to the feedback monitor and the at least one adaptive cue filter, and configured to control, in response to an output of the feedback monitor, the at least one adaptive cue filter so that the difference between the output of the at least one ITE microphone and the combined output of the at least one adaptive cue filter is reduced.

2. The hearing aid according to claim 1, wherein the cue controller is configured to lower a rate of adaptation of the at least one adaptive cue filter when a value of the output of the feedback monitor indicates feedback instability.

3. The hearing aid according to claim 1, wherein the cue controller is configured to stop adaptation of the at least one adaptive cue filter when a value of the output of the feedback monitor indicates feedback instability.

4. The hearing aid according to claim 1, wherein the cue controller is configured to stop adaptation of the at least one adaptive cue filter when a value of the output of the feedback monitor indicates feedback instability, and set the filter coefficients of the at least one adaptive cue filter to predetermined values.

5. The hearing aid according to claim 1, wherein the cue controller is configured to gradually change each of the filter coefficients of the at least one adaptive cue filter within a predetermined time period to a predetermined value when a value of the output of the feedback monitor indicates feedback instability.

6. The hearing aid according to claim 1, wherein the cue controller is configured to provide a value of a filter coefficient as a linear weighted sum of values of the filter coefficients.

7. The hearing aid according to claim 6, wherein a weight involved in the linear weighted sum is a function of an output value $\beta$ provided by the feedback monitor in response to feedback stability.

8. The hearing aid according to claim 1, wherein the filter coefficients comprise sets of predetermined filter coefficients, and the hearing aid further comprises a memory for accommodation of the sets of the predetermined filter coefficients of the at least one adaptive cue filter, wherein one of the sets of the predetermined filter coefficients is determined for a specific direction of arrival with relation to the hearing aid.

9. The hearing aid according to claim 8, wherein the at least one adaptive cue filter is loaded with the set of predetermined filter coefficients that provides a minimum difference between the output of the at least one ITE microphone and the combined output of the at least one adaptive cue filter.

10. The hearing aid according to claim 1, wherein the cue controller is configured to resume adaptation of the at least one adaptive cue filter when a value of the output of the feedback monitor no longer indicates feedback instability.

11. The hearing aid according to claim 1, wherein the at least one adaptive cue filter is prevented from further adapting when changes of values of the filter coefficients are below a prescribed threshold.

12. The hearing aid according to claim 1, wherein the audio signals from the at least one BTE sound input transducer and the at least one ITE microphone are divided into a plurality of frequency channels, and wherein the at least one adaptive cue filter is configured for individually processing the audio signals in one or more of the frequency channels.

13. The hearing aid according to claim 12, wherein the at least one BTE sound input transducer is disconnected from the processor in one or more of the frequency channels so that hearing loss compensation is based solely on the output of the at least one ITE microphone.

14. The hearing aid according to claim 1, further comprising:

a sound signal transmission member for transmission of a sound signal from a sound output in the BTE hearing aid housing at a first end of the sound signal transmission member to an ear canal of the user at a second end of the sound signal transmission member; and an earpiece configured to be inserted in the ear canal of the user for fastening and retaining the sound signal transmission member in its intended position in the ear canal of the user.

15. The hearing aid according to claim 1, wherein the cue controller is configured to control, in response to the output of the feedback monitor, the at least one adaptive cue filter so that the difference between the output of the at least one ITE microphone and the combined output of the at least one adaptive cue filter is minimized.

* * * * *